United States Patent [19]

Thibeault

[11] Patent Number: 4,563,049

[45] Date of Patent: Jan. 7, 1986

[54] ELECTRICAL PLUG OF DEAD FRONT DESIGN

[75] Inventor: Ronald Thibeault, Canton, Conn.

[73] Assignee: Cooper Industries, Inc., Houston, Tex.

[21] Appl. No.: 695,420

[22] Filed: Jan. 28, 1985

Related U.S. Application Data

[63] Continuation of Ser. No. 339,829, Jan. 15, 1982, abandoned.

[51] Int. Cl.[4] ..... H01R 13/62

[52] U.S. Cl. ..... 339/83; 339/86; 339/107; 339/75 P; 339/196 M

[58] Field of Search ..... 339/103, 107, 75 P, 339/63 R, 63 M, 196 R, 196 AM, 206, 83, 86

[56] References Cited

U.S. PATENT DOCUMENTS

| | | | |
|---|---|---|---|
| 3,865,461 | 2/1975 | Ludwig | 339/103 R |
| 4,010,999 | 3/1977 | Hoffman | 339/107 |
| 4,067,634 | 1/1978 | Hoffman | 339/107 |
| 4,169,643 | 10/1979 | Gallagher | 339/75 P |
| 4,191,443 | 3/1980 | Doyle | 339/103 R |
| 4,202,590 | 5/1980 | Hoffman | 339/107 |

*Primary Examiner*—Gil Weidenfeld
*Assistant Examiner*—David L. Pirlot
*Attorney, Agent, or Firm*—Wigman & Cohen

[57] ABSTRACT

The present invention is a quickly assembled electrical plug of dead front design. An integrally molded hinge connects the dead front terminal block to a first housing portion and a similar hinge connects the second housing portion to the first. Also connected by molded hinges to this composite assembly are two cord gripping strain relief fingers which are held in firm contact with the cord after assembly by a cover or shell. The line terminals are designed in connection with the terminal block so that their wiring screws all face in the same direction and may be connected to the cord conductors during assembly without rotation of the plug. After the cover shell is screwed onto the device, a ratchet assembly molded into one of the housing portions and cooperating with elements contained in the shell prevents inadvertent loosening of the shell.

19 Claims, 10 Drawing Figures

ELECTRICAL PLUG OF DEAD FRONT DESIGN

This application is a continuation, of application Ser. No. 339,829, filed Jan. 15, 1982, now abandoned.

BACKGROUND OF THE INVENTION

The present invention comprises a quickly assembled electrical plug of dead front design.

While many electrical wiring devices still are of the so-called live front variety, in which the conductive terminals are connected to the cord conductors through the face of the device, the trend in industry is toward the safer, dead front design. In dead front plugs, the terminals are wired from the back of the device, and the non-conductive face contains slots or the like through which the terminal prongs protrude. Several dead front plug designs have been proposed, but these generally have been complex and expensive to produce, or must be molded with the line cord in place.

SUMMARY OF THE INVENTION

The present invention concerns a dead front electrical plug comprising a cover, a composite, integrally molded assembly and contact terminals. The molded composite member includes the terminal block, a first semi-cylindrical housing portion connected to the terminal block by a molded hinge, a second semi-cylindrical housing portion connected to the first housing portion by a second molded hinge, and two cord gripping fingers integrally connected to the housing portions by further molded hinges. The terminal block of this composite member is designed so that all terminal wiring screws are accessible from the same direction. Therefore, they may be connected during assembly without the need to rotate the device. Features contained in the housing portions, the terminal block and the cover shell cooperate once the plug has been assembled and the shell added to provide resistance to longitudinal and transverse stresses that occur during use of the plug. Also molded into the housing portions is a ratchet pawl which cooperates with eight ratchet ramp surfaces on the interior of the cover shell. The ratchet action allows the shell to be screwed on, but prevents inadvertent loosening of the shell.

These and other features of the invention will be more fully described in connection with the following detailed description of a preferred embodiment.

DETAILED DESCRIPTION

Figure 1:
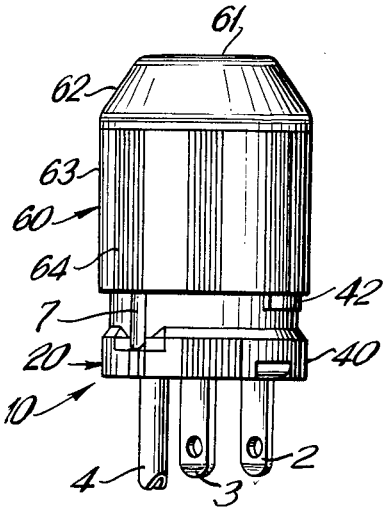
FIG. 1 is a side view of an assembled 3-wire plug according to the present invention.

The Figures show the preferred embodiment of the present invention. Referring first to FIG. 1, the invention as there pictured comprises a terminal block 10 with line terminal prongs 2 and 3 and ground terminal prong 4 extending from the front thereof, housing portions 20 and 40 interconnected by hinge 7, and a cover or shell 60 which has been screwed onto the assembly over the housing. Cover 60 has a rear end 61 with an opening therethrough for the line cord, a tapered portion 62 with a frusto-conical interior surface and a generally cylindrical portion 63 having grooved areas 64 to provide a better grip. Finally, FIG. 1 shows ratchet pawl 42 molded into housing portion 40. Its interaction with cover 60 will be clarified in the discussion of subsequent figures.

Figure 2:
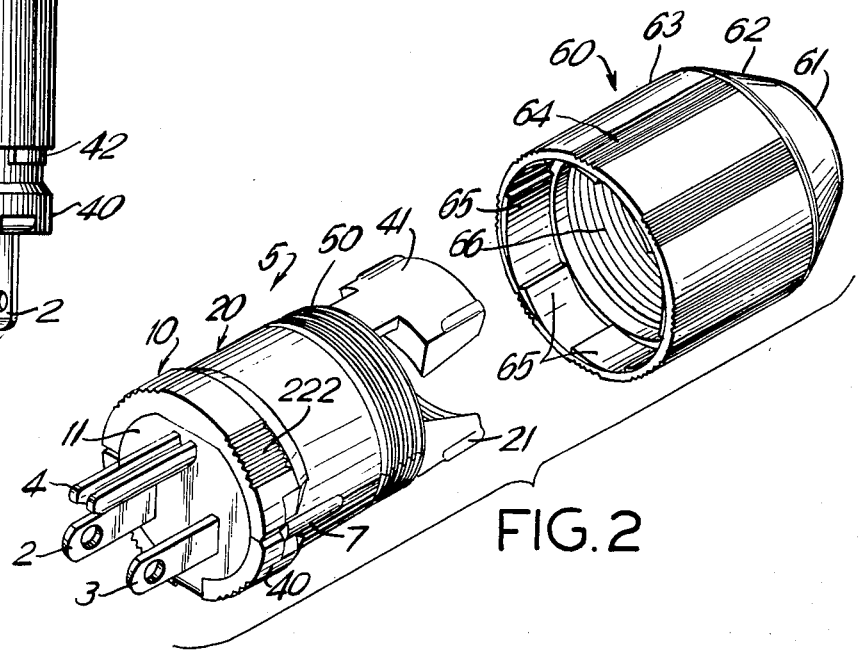
FIG. 2 is an exploded view in perspective of the 3-wire plug shown in FIG. 1.

FIG. 2 shows how cover 60 mates with the assembled composite member 5. Cover 60, at its front end, has molded onto its interior surface eight convoluted ratchet ramp surfaces 65 which interact with ratchet pawl 42 on housing portion 40 in a manner described below to prevent backing off of cover 60 after wiring and assembly. Alternatively, the device could be made with the ramp surfaces 65 on the housing portion 40 and the ratchet pawl 42 on the shell cover 60. The middle interior segment of cover 60 is threaded, as shown at 66, and the rear end of cover 60 has a frusto-conical shaped interior which terminates in opening 61 through which the line cord freely passes.

Figure 10:
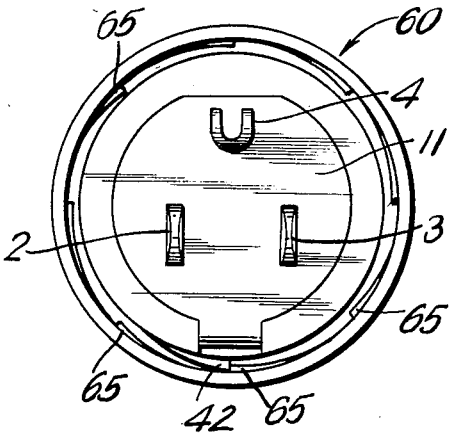
FIG. 10 is an end view of the assembled plug of the present invention.

During assembly, cover 60 first encloses cord grip fingers 21 and 41 which are integrally molded respectively onto the rear of housing portions 20 and 40, as described in more detail below. Then the threaded interior segment 66 of cover 60 engages the threaded exterior segment 50 of member 5. As the cover 60 is screwed home, the cord grip fingers 21 and 41 are forced to assume the angle of the frusto-conical interior of the cover. The fingers are thus caused to move inwardly towards each other and thereby to grip the cord which lies between them. During the last stages of tightening of cover 60 on member 5, ratchet pawl 42 will engage the convoluted ramp surfaces 65. When the tightening is complete, ratchet pawl 42 will be engaged as shown in FIG. 1, with a portion exposed where it can be reached for radially inward depression to release the ratchet action to facilitate intentional disassembly of the plug. FIG. 10 shows the mating of ratchet pawl 42 with one of ramp surfaces 65.

To facilitate the manual gripping of member 5 as cover 60 is tightened down onto that member, grooved areas such as 222 are provided around the lower end of the exterior surface of housing portions 20 and 40.

Figure 3:
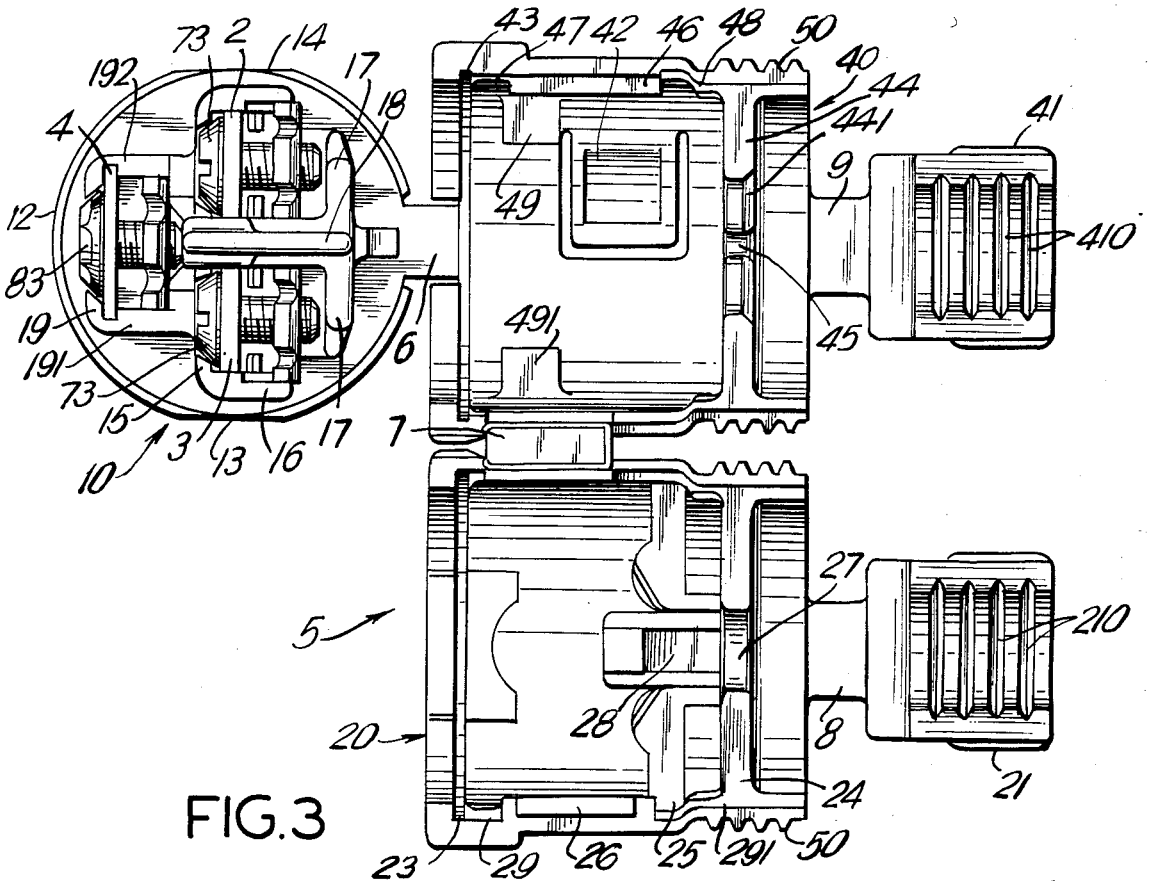
FIG. 3 is a plan view of the composite member of the present invention, shown in its unassembled configuration with the terminal prongs installed.
Figure 4:
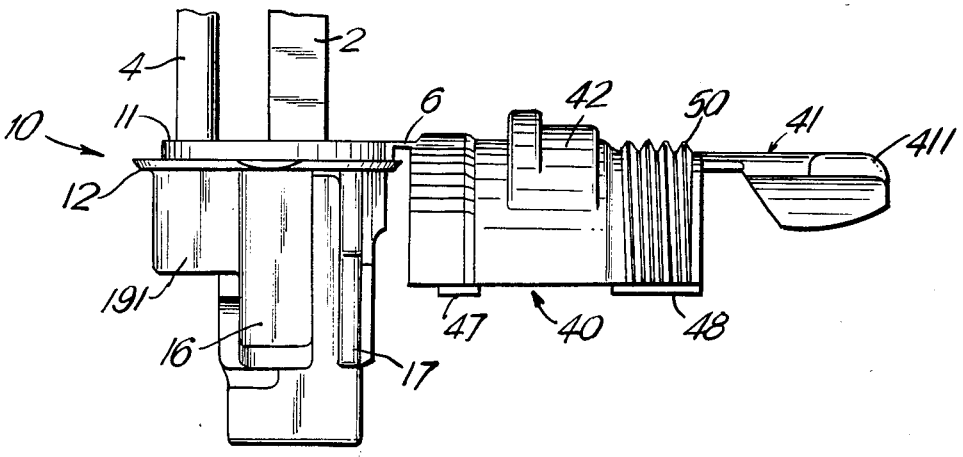
FIG. 4 is a side view of the composite member of the present invention, shown in its unassembled configuration with the terminals prongs installed.

The detailed structure of the member 5 is best seen in FIGS. 3 and 4. The five main elements of member 5 are terminal block 10, housing portions 20 and 40, and cord grip fingers 21 and 41. Terminal block 10 is connected to housing portion 40 by integrally molded hinge 6. Housing portions 20 and 40 are joined by a similar hinge 7. Cord grip fingers 21 and 41 are joined respectively to housing portions 20 and 40 by integrally molded hinges 8 and 9.

Figure 9:
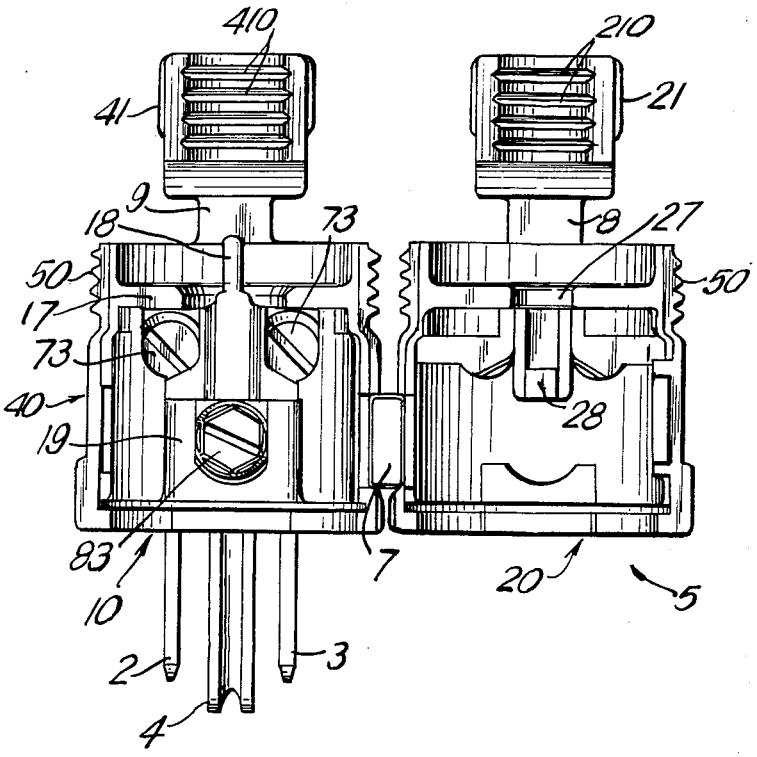
FIG. 9 is a front view of the composite member in its partially assembled state, with the terminal prongs installed.

Terminal block 10 comprises a flat front face 11 containing openings for line terminal prongs 2 and 3 and ground terminal prong 4. Immediately behind front face 11 is a disk 12 of slightly greater diameter than face 11. The perimeter of this disk seats in grooves 23 and 43 in housing portions 20 and 40 when the plug is assembled. This interlock provides resistance to longitudinal stress on the plug such as occurs when the plug is disconnected from a socket. It will be noted that disk 12 has flattened sections 13 and 14 at opposite positions around its perimeter 90° clockwise and counterclockwise from hinge 6. These flattened sections facilitate insertion of terminal block 10 into housing portion 40 in view of the relative stiffness of the preferred thermoplastics materials: polypropylene or, for high temperature environments, nylon. Formed on the rear face of disk 12 are three upstanding insulated chambers which contain the rear portions of line terminal prongs 2 and 3 and ground terminal prong 4. As is best seen in FIGS. 3, 4 and 9, the rear portion of each of terminal prongs 2 and 3 is seated in a chamber formed by front wall 15, outside wall 16, rear wall 17 and middle wall 18. Wall 15 has two arcuate cut-out portions through which protrude the wiring screws 73 of terminal prongs 2 and 3. The chamber for the rear portion of ground terminal prong 4 is bounded by front wall 19, side walls 191 and 192 and as its rear wall, the walls 15 that form the front walls of the chambers for the line terminals. Wall 19 has an arcuate cut-out portion through which protrudes the wiring screw 83 of terminal prong 4. As appears most clearly in FIGS. 4 and 9, the chamber for ground terminal prong 4 is shallower than the chambers for line terminal prongs 2 and 3, so that all three wiring screws are accessible for wiring in the same direction, a feature of the present invention which facilitates its assembly as compared to prior art devices.

Housing portion 20 contains two generally semi-circular internally mounted shelves 24 and 25 and, along its side wall remote from hinge 7, a rectangular latch 26. Shelves 24 and 25 respectively have slots 27 and 28 therethrough. Housing portion 40 contains ratchet pawl 42 and also semi-circular internally mounted shelf 44, contoured to fit around wall 18 of terminal block 10 and having slots 45 and 441 therethrough. Housing portion 40 further includes, along its side wall remote from hinge 7, a rectangular seat 46 adapted to receive latch 26 of housing 20. Latch 26 snaps into engagement with seat 46 at the end of the assembly operation. When, near the end of the plug assembly operation, housing portions 20 and 40 are brought together around terminal block 10, the lower edge of shelf 25 rests on a shoulder formed in wall 15 and shelves 24 and 44 meet. The end of the line cord abuts wall 18 which, as best shown in FIG. 9, extends upward through slot 45 above shelves 24 and 44. The ground and line conductors reach the ground and line terminal screws through slots 27, 28 and 441.

In addition, as seen in FIGS. 3 and 4, housing portion 40 includes two tabs 47 and 48 along its side wall remote from hinge 7, which tabs interlock during assembly respectively with slots 29 and 291 along the side wall of housing portion 20 remote from hinge 7. These interlocks provide additional resistance to longitudinal stress on the assembled plug. Further, housing portion 40 has molded on its inner surface blocks 49 and 491. These blocks abut the rear wall 17 of terminal block 10 when the terminal block has been rotated about hinge 6 into position within housing portion 40 during assembly, and the abutment of the blocks against wall 17 provides resistance to transverse stress arising during use of the plug.

Cord grip fingers 21 and 41 contain serrated gripping surfaces 210 and 410 and rounded shoulders on their outer surfaces, such as shoulder 411 seen on finger 41 in FIG. 4. These shoulders are contacted by the frusto-conical inner surface of cover 60 as cover 60 is screwed down onto the housing during assembly thereby causing the cord gripping action described above.

Figure 5:
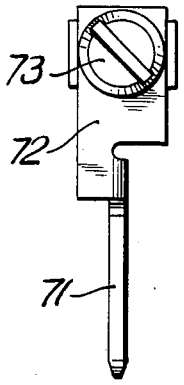
FIG. 5 is a front view of the line terminal prongs used in the plug of the present invention.
Figure 6:
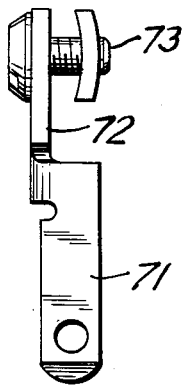
FIG. 6 is a side view of the line terminal prongs used in the plug of the present invention.
Figure 7:
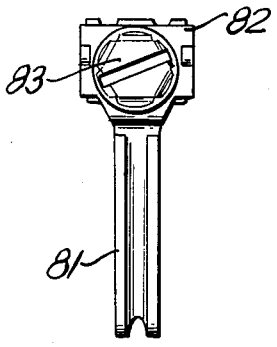
FIG. 7 is a front view of the ground terminal prong used in the plug of the present invention.
Figure 8:
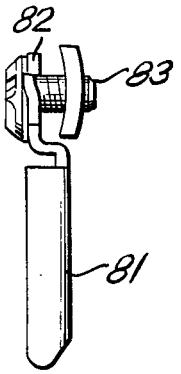
FIG. 8 is a side view of the ground terminal prong used in the plug of the present invention.

FIGS. 5 and 6 show the unique line terminal prong design utilized in the present invention to place all wiring screws in a common orientation for wiring. The terminal includes a blade 71 and a head 72 containing the wiring screw 73. Though formed from an initially flat metal blank, the plane of the head of the terminal is rotated 90° from the plane of the blade. By contrast, as seen in FIGS. 7 and 8, the ground terminal 4 has a contact element 81 formed in the standard configuration and a head 82 containing screw 83 and lying in a plane parallel to the plane of the original blank. It will be apparent to persons skilled in the art that various other terminal and blade configurations, required for other amperage and voltage applications, may be substituted for those shown in FIGS. 5–8 without departing from the spirit and scope of the present invention.

I claim:

1. An electrical connector of the dead front type comprising:

(A) a composite member of insulating material including:

(a) a terminal block having a central axis and including protruding electrical terminal prongs, (b) two substantially semi-cylindrical housing portions, each housing portion having a section that aligns with a section of the other housing portion to form a threaded exterior segment when the housing portions are brought together during assembly to form a substantially cylindrical housing having a longitudinal axis, (c) a plurality of cord grip fingers, at least one of the fingers being adjacent to but spaced from the top edge of each housing portion, (d) a first flexible hinge means connecting the housing portions along longitudinal sides thereof so that said housing portions may be pivoted together during assembly to form said substantially cylindrical housing, (e) a second flexible hinge means connecting the bottom edge of one housing portion with an edge of the terminal block so that the central axis of the terminal block may be brought into coincidence with the longitudinal axis of the housing during assembly.

(f) additional flexible hinge means connecting each cord grip finger to the top edge of the adjacent housing portion, and (B) a cover shell of insulating material having a threaded interior portion adapted to mate with the threads of the housing, the cover shell having a first end remote from the terminal block with an opening therethrough for passage of an electrical cord, the first end having a frusto-conical interior surface adapted to drive the cord grip fingers against the cord when the cover shell is screwed onto the housing, and having an opposite open end adapted to receive the assembled housing.

2. The connector of claim 1 further including ratchet means for preventing the inadvertent unscrewing of the cover shell from the housing.

3. The connector of claim 2 wherein the ratchet means comprises a pawl formed on one of the housing portions, and a plurality of ramps formed on the cover shell.

4. The connector of claim 3 wherein the pawl is formed in one of the housing portions and the plurality of ramps are formed around the interior surface of the cover shell adjacent the end thereof adapted to receive the terminal block.

5. The connector of claim 4 wherein a portion of the pawl protrudes from within the cover shell when the cover shell is fully screwed onto the housing.

6. The connector of claim 2 wherein the ratchet means comprises a pawl formed on the interior surface of the cover shell, and a plurality of ramps formed on the housing portions.

7. An electrical connector, having a longitudinal axis and comprising:

(A) a composite member including:

(a) a terminal block of insulating material having protruding electrical terminal prongs, (b) two substantially semi-cylindrical housing portions of insulating material, (c) a plurality of cord grip fingers of insulating material, at least one of the fingers being adjacent to the top edge of each housing portion, (d) a first flexible hinge means connecting the housing portions along a side edge of each housing portion so that said housing portions may be pivoted about an axis parallel to the longitudinal axis of the connector to form a substantially cylindrical housing, (e) a second flexible hinge means connecting a bottom edge of only one housing portion with an edge of the terminal block so that the terminal block may be pivoted about an axis perpendicular to the longitudinal axis of the connector into a position across the bottom of the one housing portion, (f) additional flexible hinge means connecting each cord grip finger to the top edge of the adjacent housing portion, and (B) a cover shell of insulating material having a first end remote from the terminal block with an opening therethrough for passage of an electrical cord and an opposite end adapted to receive the assembled housing, the first end having a frusto-conical interior surface adapted to drive the cord grip fingers against the cord when the cover shell receives the assembled housing containing the terminal block, (C) the housing portions and the cover shell further including cooperating means for preventing unintentional removal of the cover shell from the assembled housing.

8. An electrical connector of the dead front type, comprising:

a terminal block of insulating matarial having electrical terminal prongs extending therefrom;

two housing portions hingedly interconnected along a first pivot axis by a first hinge means integrally formed with said housing portions;

a second hinge means integrally formed with said terminal block and only one of said housing portions for pivoting said terminal block about a second pivot axis to a position interposed between said housing portions, said first and second pivot axes being non-parallel.

9. The electrical connector of claim 8 including:

cord grips integrally and flexibly connected to said housing portions for gripping an electrical cord connected to the electrical terminal prongs; and a cover shell of insulating material adapted to fit over said housing portions and engage said cord grips whereby when said cover shell is secured over said housing portions, said cover shell urges said cord grips inwardly in gripping relation with the electrical cord.

10. The electrical connector of claim 8, wherein the terminal block and two housing portions comprise a single unitary piece of molded plastic.

11. The electrical connector of claim 10, wherein said cord grips are integrally molded with said single unitary piece of molded plastic.

12. The electrical connector of claim 8, wherein said housing portions have mating portions which form a cylindrical portion with a threaded exterior when the housing portions are pivoted together during assembly, said cover shell having internal threads adapted to threadably engage the threads of the housing portions.

13. The electrical connector of claim 12, further including a ratchet means for preventing the inadvertent unscrewing of the cover shell from the housing portions, said ratchet means comprising a pawl on one of said housing portions and ramp surfaces on the interior of said cover shell engageable with said pawl.

14. An electrical connector of the dead front type, comprising:

a terminal block and first and second housing portions formed as a unitary piece of molded plastic, said housing portions being interconnected to one another by a first hinge means arranged along a first pivot axis and formed integrally with said unitary piece, said terminal block being interconnected to one of said housing portions by a second hinge means formed integrally with said unitary piece and arranged along a second axis substantially perpendicular to said first axis, said terminal block being adapted to be pivoted into said one housing portion and the second housing portion being adapted to then be pivoted to engage with the first housing half and to enclose the terminal block interposed between said housing portions;

said terminal block having electrical prongs extending therefrom which are connected to an electrical cord;

cord grips flexibly connected to said housing portions; and a cover shell adapted to fit over the housing portions when engaged, whereby when the cover shell is secured over the housing portions, the cover shell urges the cord grips against the electrical cord.

15. The electrical connector of claim 14, wherein said unitary piece of molded plastic further includes the cord grips integrally formed therewith.

16. The electrical connector of claim 14, further including a ratchet means for preventing the inadvertent unscrewing of the cover shell from the housing portions, said ratchet means comprising a pawl on one of said housing portions and ramp surfaces on the interior of said cover shell engageable with said pawl.

17. The electrical connector of claim 8, wherein said electrical terminal prongs comprise a ground terminal prong and a pair of line terminal prongs, each terminal prong having a rear portion with a threaded opening therein, a wiring screw threaded into each threaded opening, the axes of the threaded openings of each rear portion being substantially parallel to one another whereby the wiring screws of said ground and line terminal prongs are all commonly oriented in the same direction to facilitate wiring of the terminals.

18. The electrical connector of claim 14, wherein said electrical terminal prongs comprise a ground terminal prong and a pair of line terminal prongs, each terminal prong having a rear portion with a threaded opening therein, a wiring screw threaded into each threaded opening, the axes of the threaded openings of each rear portion being substantially parallel to one another whereby the wiring screws of said ground and line terminal prongs are all commonly oriented in the same direction to facilitate wiring of the terminals.

19. An electrical connector of the dead front type comprising:

a terminal block of insulating material having electrical terminal prongs extending therefrom, said electrical terminal prongs comprising a ground terminal prong and a pair of line terminal prongs, each terminal prong having a rear portion with a threaded opening therein, a wiring screw threaded into each threaded opening, the axes of the threaded openings of each rear portion being substantially parallel to one another whereby the wiring screws of said ground and line terminal prongs are all commonly oriented in the same direction to facilitate wiring of the terminals;

a pair of housing portions;

a first hinge means integrally formed with said housing portions for hingedly interconnecting said housing portions along a first pivot axis; and a second hinge means integrally formed with said terminal block and one of said housing portions for pivoting said terminal block about a second pivot axis perpendicular to said first pivot axis to a position interposed between said housing portions.

* * * * *